US005437381A

United States Patent [19]

Herrmann

[11] Patent Number: 5,437,381

[45] Date of Patent: Aug. 1, 1995

[54] NURSING BOTTLE

[76] Inventor: Shlomo Herrmann, Talmon B, Mobile Post Modiin 71935, Israel

[21] Appl. No.: 239,031

[22] Filed: May 6, 1994

[51] Int. Cl.[6] ..... A61J 9/00

[52] U.S. Cl. ..... 215/11.1; 215/6

[58] Field of Search ..... 215/11.1, 11.2, 11.3, 215/11.4, 6, 11.6; 222/464, 563

[56] References Cited

U.S. PATENT DOCUMENTS

| | | | |
|---|---|---|---|
| 1,918,307 | 7/1933 | Webber | 215/11.6 X |
| 3,143,255 | 8/1964 | Leeds | 222/563 X |
| 3,506,157 | 4/1970 | Dukess | 222/563 X |
| 4,856,995 | 8/1989 | Wagner | 215/11.1 X |
| 4,898,060 | 2/1990 | To | 215/11.1 X |
| 5,029,701 | 7/1991 | Roth et al. | 215/11.1 X |
| 5,244,122 | 9/1993 | Botts | 215/11.1 X |

*Primary Examiner*—Allan N. Shoap
*Assistant Examiner*—Christopher J. McDonald
*Attorney, Agent, or Firm*—Thomas R. Vigil

[57] ABSTRACT

A dual compartment nursing bottle, especially suitable with the aim of preventing caries in infants includes a valveless dual compartment nursing bottle, comprising a first container delimiting a first compartment having a neck portion to which a nipple is attachable and a second container delimiting a second compartment provided with a closure member having at least one relatively narrow outlet port for said second compartment and at least approximately reaching the level of said neck portion.

7 Claims, 1 Drawing Sheet

NURSING BOTTLE

FIELD AND BACKGROUND OF THE INVENTION

Tooth decay (caries) is caused by the decomposition, due to bacterial action, of sugars left by liquid or solid foodstuffs in the oral cavity in general and on the teeth in particular. This decomposition produces acids that are liable to attack and eventually dissolve the tooth enamel, resulting in tooth decay.

The modern attitude with respect to tooth decay is to take preventive measures at the earliest possible stage, that is, with the appearance of the first milk teeth of an infant, by removing from the oral cavity all traces of the sugars in their various forms contained in practically all liquid nutrients. Bottle-fed babies and toddlers cannot, however, be expected to rinse their mouths after drinking their bottles of milk, fruit Juice, etc., and must have their mouths cleansed for them.

SUMMARY OF KNOWN ART

A dual-compartment nursing bottle is known from U.S. Pat. No. 4,856,995 (Wagner), which teaches the accommodation to two different liquids in one and the same bottle, one being a sugar-free liquid, like water, to serve as rinsing agent. Switching over from one liquid to the other is effected by the manual activation of a valve.

A similar bottle is also disclosed by U.S. Pat. No. 5,060,811 (Fox), which also uses a valve arrangement to switch from one compartment to the other.

These two prior-art bottles are complex and thus expensive devices, requiring also the attention and intervention of an adult to catch the moment all the nutrient liquid has been drawn in order to at once switch over to the sugar-free rinsing liquid, since an undue delay in switching-over is liable to cause the infant to detect the "ruse" and to refuse to continue to drink the disappointingly sugar-less substitute.

OBJECTS OF THE INVENTION

It is thus one of the objects of the present invention to provide a nursing bottle that, after its nutrient contents have been consumed, automatically supplies a further quantity of liquid, this time a sugar-free liquid such as water, which, when reaching the infant's oral cavity, cleanses the latter of the remnants of the sugar-containing nutrient, with the automatic switch-over producing first a certain amount of diluted but still somewhat tasty nutrient, making the transition less abrupt.

BRIEF SUMMARY OF THE INVENTION

According to the invention, this is achieved by providing a valve-less dual compartment nursing bottle, comprising a first container delimiting a first compartment having a neck portion to which a nipple is attachable by means of a Joining member, and a second container delimiting a second compartment provided with a closure member having at least one relatively narrow outlet port for said second compartment and at least approximately reaching the level of said neck portion, said first compartment serving to accommodate a first liquid and said second compartment serving to accommade a second liquid, wherein, upon the nipple being sucked, said first liquid is the first to be drawn, said second liquid starting to flow only after said first compartment has been substantially emptied of said first liquid.

DETAILED DESCRIPTION OF PREFERRED EMBODIMENTS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
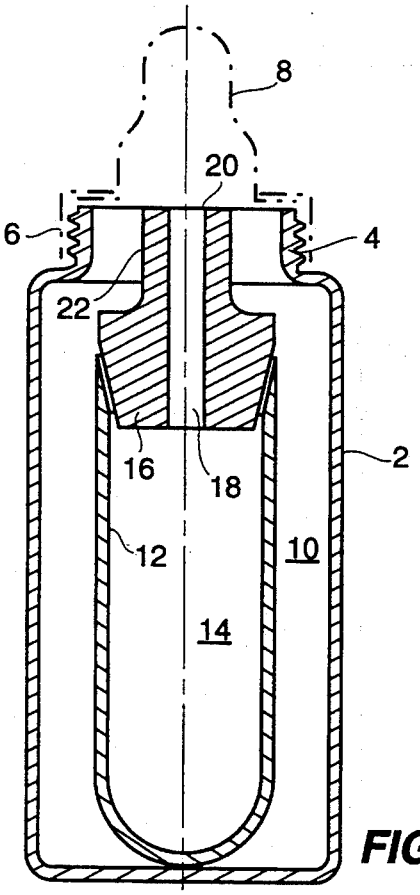
FIG. 1 is a cross-sectional view, partly schematic, of a preferred embodiment of the invention.

Reffering now to the drawings, there is seen in FIG. 1 a valve-less nursing bottle, comprising a first container 2 having a threaded neck portion 4 to which, by means of a Joining member 6, is attached a nipple 8 (both the member 6 and the nipple 8 being represented schematically by dash-dotted lines). The container 2 delimits a first, annular compartment 10 and is intended to be filled with the liquid food (milk, Juice, diluted syrups, etc.).

Figure 2:
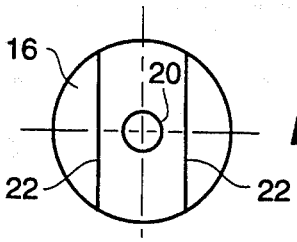
FIG. 2 is a top view of the stopper of the embodiment of FIG. 1.

Further seen is a second, tubular container 12, delimiting a second compartment 14, provided with a stopper 16 and introducible into the first container 2. The stopper 16, a top view of which is seen in FIG. 2 is advantageously tapered and provided with a central bore 18, the upper end 20 of which serves as outlet port for a sugar-free rinsing liquid such as water, with which the second container is intended to be filled. To facilitate handling, the stopper 16 is advantageously provided with flats 22 (see also FIG. 2).

As can be seen in FIG. 1, in the assembled state of the nursing bottle, the outlet port 20 of the stopped 16 is approximately at the level of the edge of the neck portion 4. This is important, as it will prevent mixing of, or diffusion between, the two liquids prior to feeding, and reduce them to a minimum during feeding.

The already mentioned automatic switch-over action from the feeding liquid to the rinsing liquid is based on the fact that, when the nursing bottle according to the invention is turned over into the feeding position, the feeding liquid easily flows out because of the relatively large free cross-section of the neck portion 4, and fills the hollow space of the nipple 8, to be drawn off by the sucking action of the infant, with the necessary air entering the compartment 10 between the successive sucking episodes. The cross-sectional area of the outlet port 20 of the stopper 16, on the other hand, is relatively small, retaining the rinsing liquid in the compartment 14 until the entire volume of the feeding liquid in compartment 10 has been consumed, when air can enter through the port 20, permitting the drawing-off of the rinsing liquid.

Figure 3:
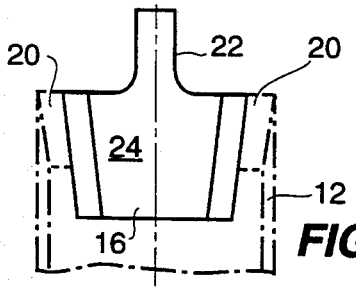
FIG. 3 is a front view of a variant of the stopper of FIG. 2.
Figure 4:
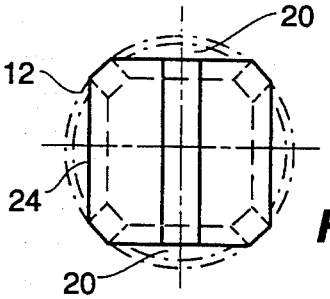
FIG. 4 is a top view of the stopper of FIG. 3.

FIGS. 3 and 4 represent a variant of the stopper 16, which has no central bore. Instead, a number of flats 24 are provided, which produce the outlet ports 20.

Figure 5:
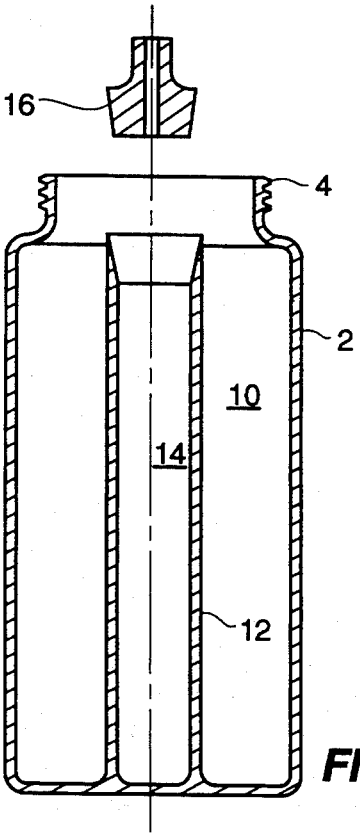
FIG. 5 represents another embodiment of the invention in which the second container is an integral part of the first container.

In another embodiment of the invention represented in FIG. 5, the second container 12 is an integral part of the first container. Seen also is the stopper 16.

Figure 6:
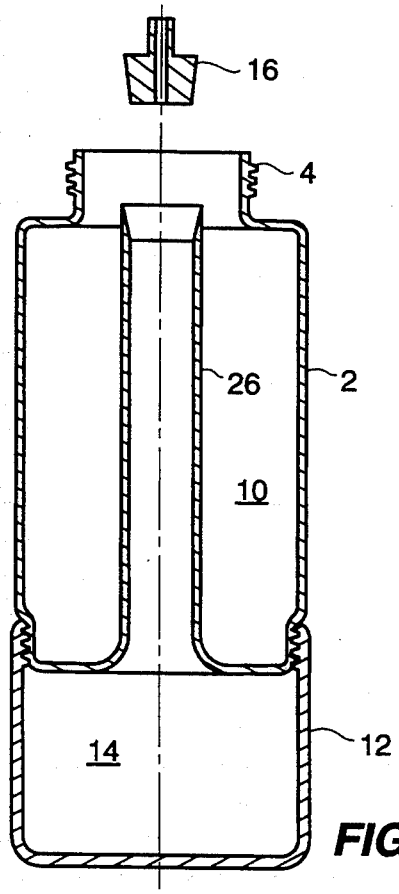
FIG. 6 shows yet another embodiment, in which the second container is attached to the bottom end of the first container.

In the embodiment illustrated in FIG. 6, the second container 12 is screwed onto the bottom end of the first container 2, and communicates with the neck portion 4 of the first container 2 via a duct 26, which is an integral part of the first container 2 and is closeable by means o the stopper 16.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A valveless dual compartment nursing bottle, comprising a first container, defining a first compartment, having a neck portion to which a nipple is attachable by means of a joining member, and a second container, defining a second compartment including a closure member having at least one relatively narrow outlet port for said second compartment and said outlet port being positioned approximately at the level of said neck portion but not extending beyond said neck portion, said first compartment serving to accommodate a first liquid and said second compartment serving to accommodate a second liquid, whereby, upon the nipple being sucked, said first liquid is the first to be drawn, said second liquid starting to flow only after said first compartment has been substantially emptied of said first liquid.

2. The nursing bottle as claimed, in claim 1, wherein said second container is a separate unit introducible into said first container.

3. The nursing bottle as claimed, in claim 1, wherein said second container is a separate unit attachable to the bottom end of said first container.

4. The nursing bottle as claimed in claim 1, wherein said second container is an integral part of said first container.

5. The nursing bottle as claimed in claim 1, wherein said outlet port is a bore passing through said closure member.

6. The nursing bottle as claimed in claim 2, wherein said second compartment is defined by a tubular container and said closure member is a stopper insertable into said container.

7. In a nursing bottle having a neck portion to which a nipple is attachable by means of a joining member, a tubular container introducible into said bottle and including a stopper having at least one outlet port, said tubular container being of such a height relative to said bottle that, when introduced thereinto, said outlet port is positioned approximately at, but not beyond the level of said neck portion.

* * * * *